United States Patent [19]

Carroll

[11] Patent Number: 4,711,478

[45] Date of Patent: Dec. 8, 1987

[54] HIGH SECURITY DEADLOCKING DOOR LATCH

[76] Inventor: Charles Carroll, 2900 Linden La., Falls Church, Va. 22042

[21] Appl. No.: 931,416

[22] Filed: Nov. 14, 1986

Related U.S. Application Data

[63] Continuation-in-part of Ser. No. 550,745, Nov. 10, 1983, Pat. No. 4,623,175.

[51] Int. Cl.[4] ..... E05C 1/16

[52] U.S. Cl. ..... 292/173

[58] Field of Search ..... 70/143; 292/DIG. 44, 292/169 R-169.23, 337, 1

[56] References Cited

U.S. PATENT DOCUMENTS

| | | | |
|---|---|---|---|
| 2,119,175 | 5/1938 | Niederdrenk | 70/143 |
| 2,346,618 | 4/1944 | Schlage | 70/143 |
| 3,872,697 | 3/1975 | Wellekens | 70/143 |
| 4,623,175 | 11/1986 | Carroll | 70/143 |

*Primary Examiner*—Richard E. Moore

*Attorney, Agent, or Firm*—Poms, Smith, Lande & Rose

[57] ABSTRACT

An extra-long deadlocking door latch or longlatch is arranged to fit and operate within the normal latch bolt openings provided in a standard pre-cut residential or commercial door, in the presence of two transverse bolts which pass through the transverse hole in the door to hold inside the outside door knob assemblies securely against the door so that an intruder cannot pry off the outside assembly and thus gain entry. The longlatch is arranged to protrude at least one inch out from the door and into a latch holder in a door frame. Two springs are located above the transverse bolts and extend into the door beyond both transverse bolts. The two springs, or just one of the springs, can move the longlatch one inch or more from the fully withdrawn position to the fully extended position. The longlatch is brought to the fully extended position in precisely the same way as is done with a conventional deadlocking latch, i.e., the inside door knob assembly is set to its locked position and the door is simply pulled closed from the outside, resulting in a deadlocked state with the longlatch extending at least one inch from the door, and into the latch holder. The longlatch is mounted in a cylinder which extends not only through the normal hole from the edge of the door, but also most of the way through the larger transverse hole provided in a pre-cut door, which is aligned with the usual position of the door knob.

16 Claims, 14 Drawing Figures

HIGH SECURITY DEADLOCKING DOOR LATCH

RELATED PATENT APPLICATIONS

This application is a continuation-in-part of U.S. patent application Ser. No. 550,745, filed Nov. 10, 1983, now U.S. Pat. No. 4,623,175, granted Nov. 18, 1986.

FIELD OF THE INVENTION

This invention relates to a combined door latch and deadbolt.

BACKGROUND OF THE INVENTION

A normal door latch only extends about ½ inch from the front edge of the door. When consideration is given to the normal space between the door frame and the outer edge of the door, there may only be about ⅜ inch of the latch which may penetrate the opening in the striker plate or latch holder. With this minimal engagement, a good strong kick in the center of the door may bow the door so that the latch is released; or a simple prying tool may be employed to release the door, and permit undesired entry. In order to avoid this problem, many people now use a supplemental deadbolt which is normally key-operated, and which extends into the door frame a full inch. This precludes opening of the door by the simpler expedients mentioned hereinabove. It is also noted in passing that some insurance companies will give reduced rates to home owners who equip their homes with deadbolts on the exterior doors, which extend one inch out from the door, and certain other safety equipment.

One prior proposed arrangement for a combination latch and deadbolt lock is disclosed in H. Dietrich, et al. U.S. Pat. No. 4,255,953, granted Mar. 17, 1981. This prior patent includes two modes of operation. In one mode of operation the latch only extends for the usual ½ inch, and the door operates in all respects like a normal door. Then, through the special use of a key or other actuation arrangements, the conventional type of latch is extended by an additional half an inch so that it acts in the manner of a deadbolt. It is noted, however, that although the latch and deadbolt functions are accomplished by this single device, the one-inch deadbolt can be actuated from the outside of a door in which it is installed only by inserting and turning a key.

The simple action of inserting and turning a key, as important as it is in providing the greatly increased security of a deadbolt lock when compared to a conventional latch, is one which many people are unwilling to do regularly. Perhaps the best illustration of this fact is that the great majority of hotel and motel rooms can be locked from the outside only by closing the door. Deadbolt locks are generally provided, but they can be locked only from the inside. Thus, in spite of the small extra cost of installing deadbolt locks which can be locked from both sides of the door in order to provide much greater security, to the benefit of both management and guests of hotels and motels, this cost is evidently considered excessive in view of the evident low probability that the outside deadlocking arrangements would be used. Similarly, this reluctance to use a key to lock a door from the outside applies as well to people locking the doors of their homes.

Accordingly, a principal object of the present invention is to provide an improved combination latch and deadbolt in a single inexpensive unit which will fit conventionally cut doors, and which can be locked from the outside by merely pulling the door closed, thus providing the convenience of a conventional latch as well as the security of a deadbolt.

SUMMARY OF THE INVENTION

In accordance with the present invention, a long deadlocking door latch assembly includes a longlatch which extends at least one inch from the front edge of the door, and also includes a striker plate having an opening to receive the longlatch, and an angled depressor portion for engaging the beveled outer edge of the extended longlatch and for moving it to the retracted position as the door is being closed. This means that the depressor portion of the striker plate must extend away from the recess to be engaged by the longlatch sufficiently far, depending upon its angle, to engage the beveled outer edge of the extended longlatch, so that as the door is swung closed, the longlatch will be pushed back into the door. The depressor portion beyond the point where the latch strikes it, may be bent so that it touches or almost touches the door frame, to prevent clothing and other articles from catching on the depressor portion.

In accordance with another feature of the invention, the fixed guide or housing for the longlatch extends not only through the normal smaller opening of a pre-cut door, but also more than half way through the larger transverse cylindrical hole which is provided in pre-cut residential doors. This elongated guide provides the desired full support for the longlatch to give it adequate strength desirable in secure deadbolts. It also provides the space for the springs and other parts which permit the longlatch to move back and forth by one full inch.

Additional features of the invention include the provision of a longlatch retracting member which is engageable by the lever arm operated by the door knobs, which is movable both in the axial direction aligned with the longlatch and also transverse thereto, to facilitate the mechanically efficient application of retracting force to the longlatch against the normal spring biasing force, over the necessary long throw provided by the one inch extension of the longlatch during normal latching operations. In addition, a deadlocking plunger is provided to control the operation of a deadlocking catch which holds the longlatch against local mechanical retraction, when the deadlocking plunger engages the face of the striker plate. Camming surfaces are provided to shift the position of the deadlocking catch and to release the longlatch and permit its movement to the retracted position when the deadlocking plunger is in its extended position, or when a door knob is actuated. Also, the fixed elongated guide or housing for the longlatch is preferably cylindrical, with long biasing springs for the longlatch extending well beyond the axle between the door knobs, which may pass through the cylindrical guide, along with transverse bolts for holding the knob assemblies together.

As mentioned above, the springs for biasing the longlatch to its extended position preferably extend at least more than half way across and preferably most of the way across the transverse opening in standard pre-cut doors. The transverse bolts extending through the assembly and the door knob axle may be mounted above or preferably below the centerline of the transverse opening, to avoid mechanical interference with the springs.

Two major advantages of the present invention are that when closing the door in normal usage, a one inch extension of the longlatch is always obtained, and that deadlocking action is automatically obtained whenever the inside knob is set to the locked position.

Other objects, features and advantages of the invention will become apparent from a consideration of the following detailed description and from the accompanying drawings.

Figure 8:
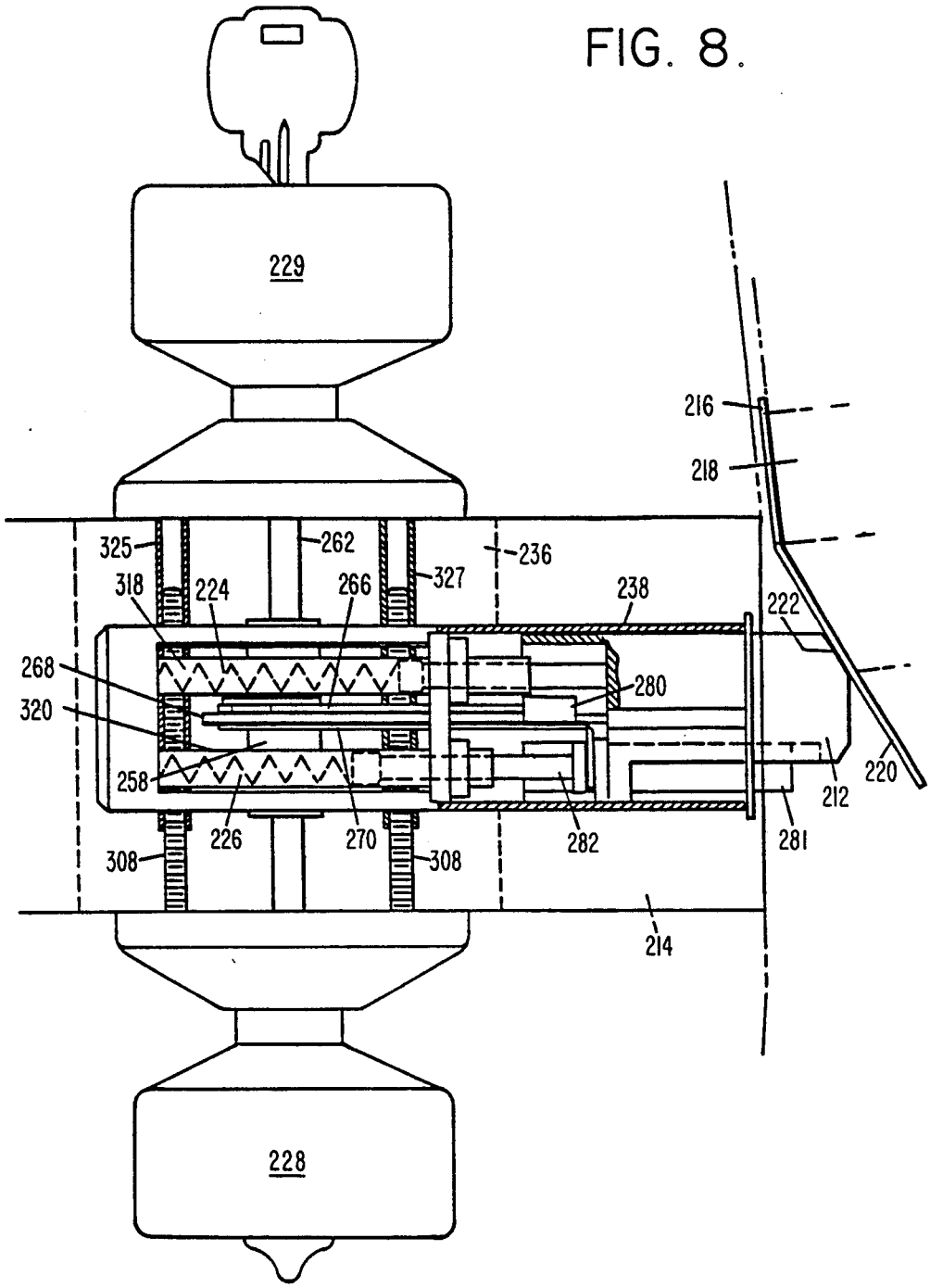
Figure 10:
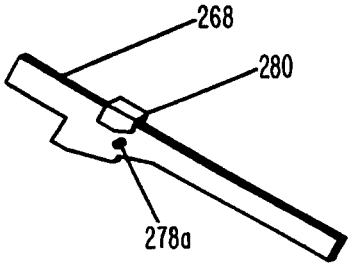

FIGS. *7a*, *7b* and *7c* together show an exploded view of a combined latch and deadbolt assembly;

FIG. 8 is a top view of another embodiment of the invention;

FIGS. *9a* and *9b* constitute an exploded view of a portion of the longlatch configuration which may be substituted for FIGS. *7a* and *7b* to show a slightly modified latch coupling arrangement;

FIG. 10 is a perspective view of one of the parts shown in FIG. *9b*; and

Figure 11:
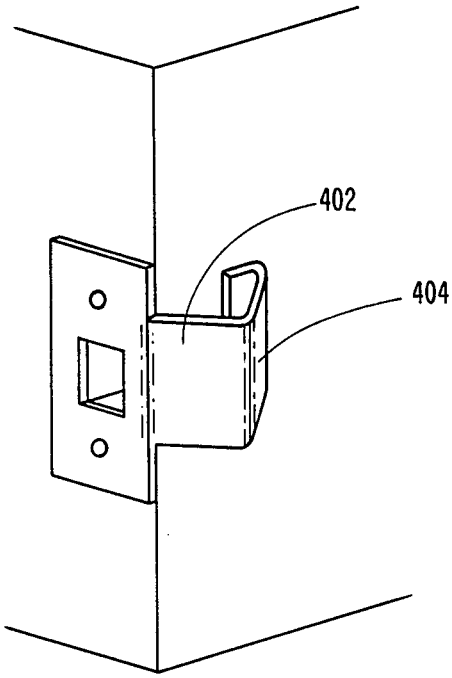

FIG. 11 shows an alternative striker plate configuration.

DETAILED DESCRIPTION

Figure 1:
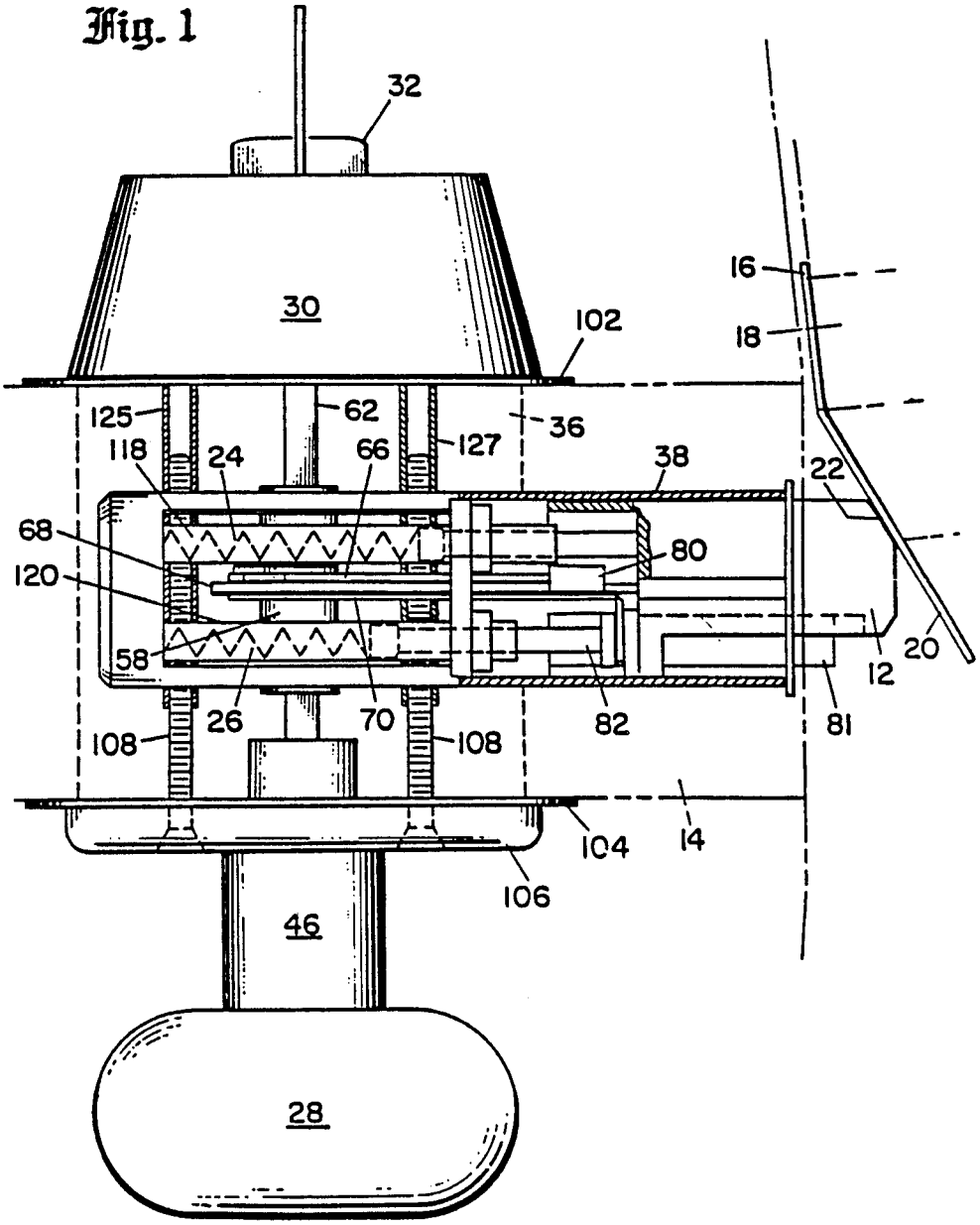
FIG. 1 is a cross-sectional view showing a combined door latch and deadbolt illustrating the principles of the invention.

Referring more particularly to the drawings, FIG. 1 is a cross-sectional view showing a latch and deadbolt 12, mounted in a door 14 for engagement with a striker plate 16 having a recess 18 for receiving the long latch member 12, and a depressor portion 20 for engaging the bevel 22 on one corner of the longlatch 12 and for causing the movement of the latch 12 inwardly of the door 14, against the spring pressure of the two coil springs 24 and 26. As shown in FIG. 1, the door 14 may be provided with a conventional rotating knob 28 inside the house or other structure, and a key assembly 30 together with a separate handle 32 mounted on the outside of the door.

Figure 2:
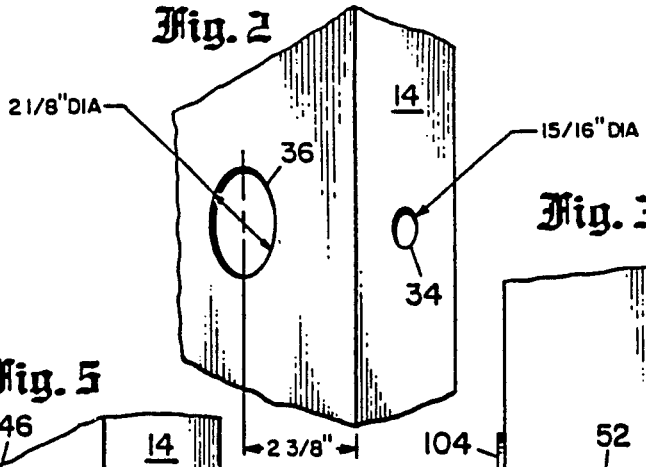
FIG. 2 shows a conventional pre-cut wooden door with the location and sizes of the holes normally included in such a door shown in this view.

Incidentally, the standard opening for latches or locks in a residential door includes a 15/16 inch diameter hole 34 extending inwardly from the edge of the door 14, all as shown in FIG. 2, and a larger 2⅛ inches diameter hole 36 centered at the same elevation as the smaller hole but extending transversely through the door, with the larger hole being centered at a distance of 2⅜ inches from the front edge of the door. It is important that a lock assembly be configured to fit into these standard pre-cut door openings.

Now, referring back to FIG. 1 of the drawings, it may be noted that the longlatch 12 is mounted within a cylindrical housing 38 which extends from the front edge of the door 14 through the length of the smaller hole 34, and most of the way across the larger hole 36. This gives good support to the longlatch 12 and provides good security and impact resistance to the entire assembly, if an effort is made to force the door 14 while the longlatch 12 is in position in the recess 18.

Figure 3:
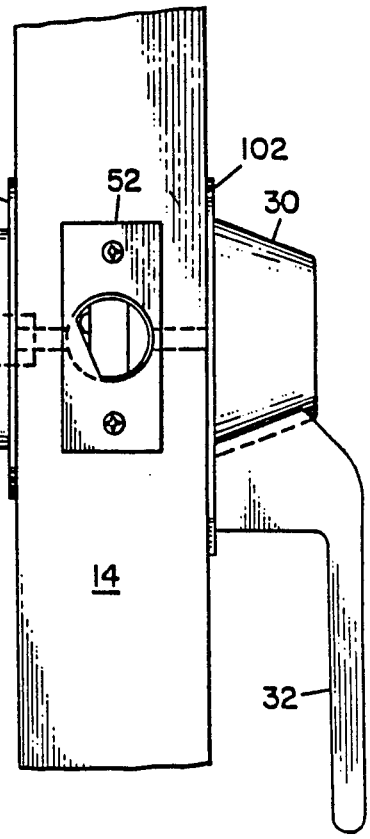
FIG. 3 is a view of a door equipped with a combined latch and deadbolt illustrating the principles of the invention.
Figure 5:
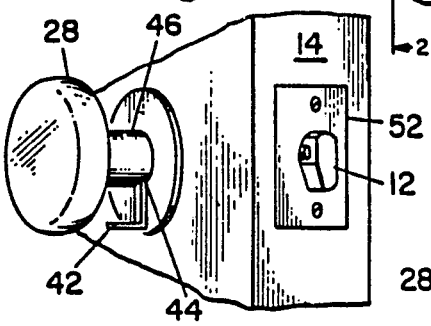
FIG. 5 is a showing of a unit illustrating the principles of the invention from the inside of a home, with the knob mounted on the inside of the door and a detent pressed upward to hold the latch in the partially retracted position.
Figure 5:
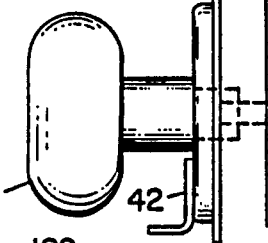
Figure 4:
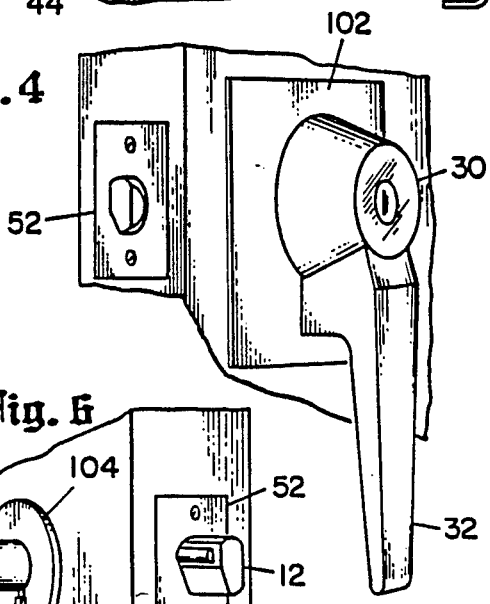
FIG. 4 is a showing of the door of FIG. 3 from the outside thereof.
Figure 6:
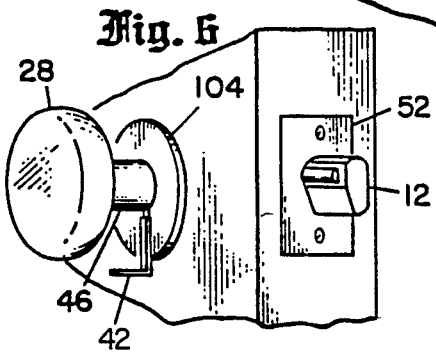
FIG. 6 is a showing from the inside of a home with the detent inactive and with the longlatch member being fully extended.
Figure 7A:
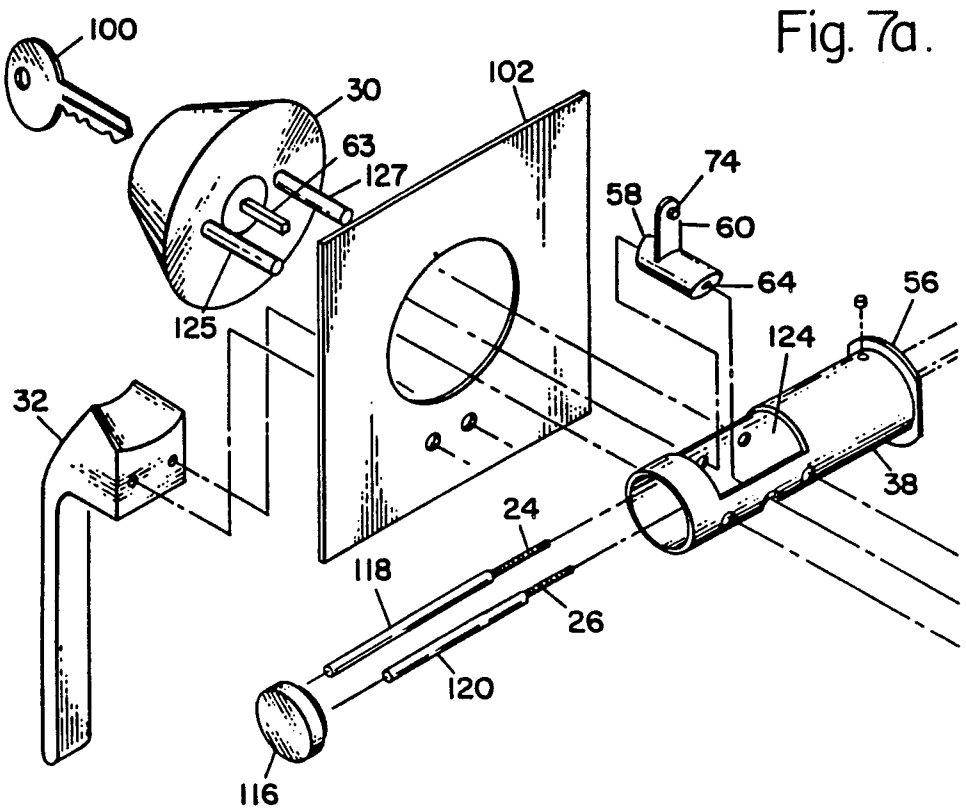
Figure 7B:
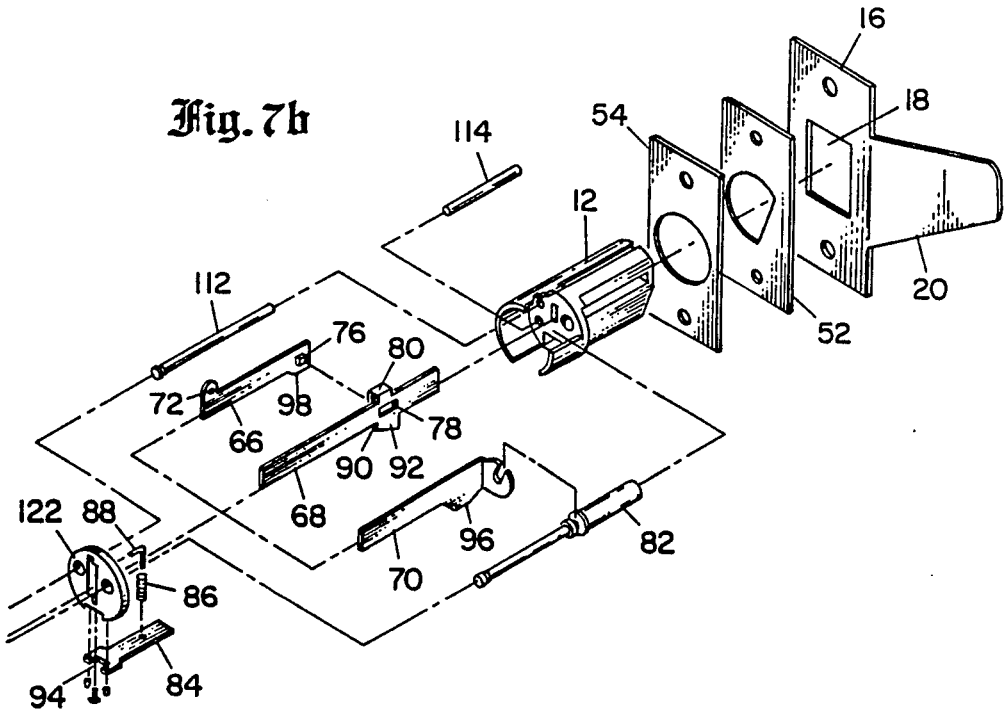
Figure 7C:
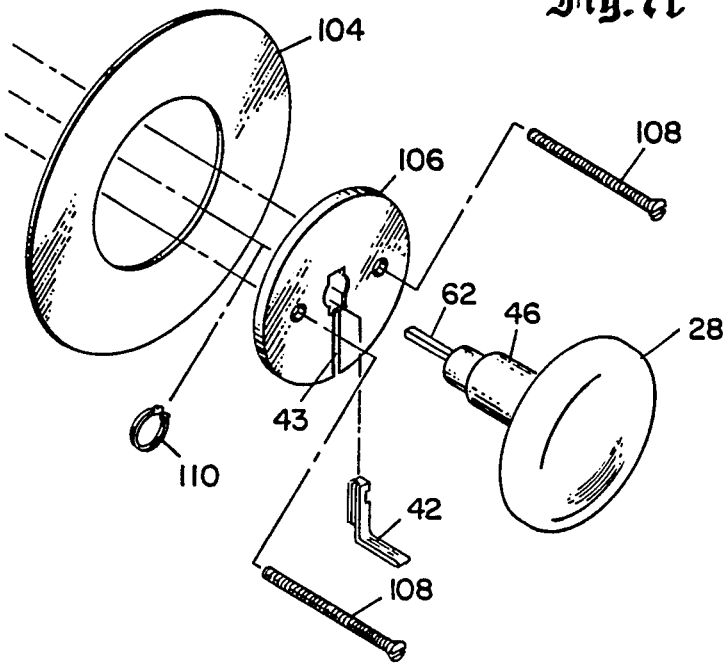

Now, considering the figures which appear on sheet 2 of the drawings, these include FIGS. 2 through 6. FIG. 2, as previously mentioned, shows the location of the drilled holes included in a pre-cut residential door. FIG. 3 is a view of the structure shown in FIG. 1 as viewed from the edge of the door 14. FIG. 4 is a similar view to that of FIG. 3 but taken from a slight angle outside of the door, from the side of the door with the keyhole assembly 30 and the handle 32. FIGS. 5 and 6 show a door installation with the detent 42 in two different positions in the two figures. The detent 42 may be located either at the top or above the knob 28 or below the knob 28 as shown in the drawings. Although either arrangement may be employed, the location of the detent below the knob 28 is slightly to be preferred as the detent may be operated with the forefinger in the manner of a trigger, with this arrangement.

The detent 42 may be omitted, as for hotel room locks, along with the slot 43 (in the face plate 106) and the recess 44, so that the door 14 is locked whenever it is closed.

Returning to FIGS. 5 and 6, in FIG. 5, the detent 42 is pressed up to engage the recess 44 in the cylindrical member 46 forming part of the knob assembly. With the detent in recess 44, the rotation of the knob assembly is limited, and the longlatch 12 only extends a very short distance from the front edge of the door 14. However, as shown in FIG. 6, with the detent 42 being released, and no longer in engagement with the recess in the cylindrical member 46 forming part of the door knob, the latch 12 is free to extend for the full inch or more of travel, under the outward pressure from the coil springs 24 and 26, so that full deadlocking action obtains, whenever the door is closed.

FIGS. *7a* and *7b* together form an exploded view of the latch, deadbolt and deadlocking assembly shown in cross section in FIG. 1. The major components shown in FIG. *7a* and *7b* which have not been specifically referenced above, include the latch faceplate, made up of two plates 52 and 54, with the front plate 52 being exposed at the edge of the door as shown in FIG. 3, for example, and the plate 54 being mounted on the other side of the flange 56 at the front edge of the elongated cylinder 38, thereby holding the cylinder 38 firmly in place in door 14. Incidentally, the elongated cylinder 38 appears at the right hand side of FIG. *7a*, while the plates 52 and 54 appear at the upper right in FIG. *7b*.

A cam member 58 provided with a lever arm 60 is mounted on the shafts 62 and 63 for rotation as the knob 28 or the key 100 is rotated. The shafts 62 and 63 may be square, or of a round configuration with a flat on one side for engaging with a mating hole 64 extending through the body of the cam member 58. There are three flat members 66, 68, and 70 which are mounted close to one another as shown in FIG. 1, and also in FIG. *7b*. The upper one of these flat strips, the latch pulling strip 66, is provided with a recess or hole 72 which is engaged by the pin 74 on the lever arm 60 secured to the cam member 58. The central flat shaft or plate 68 is rigidly secured to the longlatch 12. A driving pin 76 on the latch pulling strip 66 extends through the slot 78 in the central shaft 68, with the bent arm 80 extending over the latch pulling strip 66 to preclude disengagement of the pin 76 from the slot 78. When the knob 28 or the key 100 is turned, and the camming member 58 is rotated, the lever arm 60 is moved counterclockwise as shown in FIG. *7a* and the latch pulling strip 66 is moved to the left as shown in FIG. *7b*, the pin 76 engages the rear of the slot 78, and the central shaft 68 together with the longlatch 12 are retracted and moved to the left as shown in FIG. *7b*, against the force of the coil spring 24, and also the force of the spring 26.

The operation of the deadlocking plunger 82 and the deadlocking catch 84 will now be described. In general, the purpose of a deadlocking plunger is to prevent movement of the latch by direct engagement of a latch with a tool or a credit card, for example, when the door is closed, and the latch is properly located in the opening in the striker plate. In operation, the deadlocking plunger, such as plunger 82, rests on the outer surface of the striker plate and does not penetrate the striker plate, and this operation, which is of course different from the operation of the deadlocking plunger 82 which moves with the longlatch 12 when the door is open, is employed to implement the deadlocking function.

The small coil spring 86 guided by the pin 88, is mounted below the deadlocking catch 84 to mechanically bias the front end of the deadlocking catch upwardly so that it is behind the detent formed by the rear edge 90 on the downwardly extending lug 92 of the central shaft 68. Incidentally, the deadlocking catch 84 is pivoted at its rear end 94, at the bottom of disk 122. Now, when the deadlocking plunger is in its forward position, fully extended, when the door is open, the lower surface 96 on the deadlocking catch disabling strip 70 engages the front end of the deadlocking catch 84 and pushes it down so that it cannot engage the detent 90. Then, as the door is swung closed, the depressor plate 20 may freely force the latch 12 into its retracted position against the force of the coil springs 24 and 26. It may also be noted that the latch 12 is provided with a slot at its lower rear end to receive the (inactive) deadlocking catch 84 as the door is closed and the longlatch 12 moves into cylinder 38.

Now, assuming that the door is closed and that the latch is in its locked position in the recess 18, the deadlocking plunger 82 will be resting on the face of the striker plate 16, and the deadlocking catch disabling strip 70 will be pushed to the rear, so that it does not interfere with the upward movement of the deadlocking catch 84. Under these conditions, the front edge of the deadlocking catch 84 will lie behind the detent 90, so that a mechanical force by a tool or a credit card on the latch 12 would not cause its movement toward the retracted or opening condition. However, when the door knob 28 or the key 100 is turned, as mentioned above, the latch pulling strip 66 is moved to the left, and, prior to the engagement of the pin 76 with the rear of the slot 78 on the central shaft 68, the lower camming surface 98 on the latch pulling strip 36 will engage the deadlocking catch 84 and push it down, away from possible engagement with the detent 90. Thus, as the pin 76 reaches the rear of the slot 78, the deadlocking catch 84 has been disabled, and the central shaft and its associated longlatch are free to be moved to the retracted position.

For completeness, certain other parts which appear in FIGS. *7a* and *7b* will be noted. At the far upper left in FIG. *7a*, a key 100 is shown. On either side of the door are face plates 102 and 104 which may, of course, be either rectangular, as 102 is shown, or circular, as 104 is shown. Plate 106 adjacent the inner face plate 104, serves to mount the detent 42, and the bolts 108 pass through openings in the plate 106 and engage the threaded sleeves 125 and 127 extending from the key tumbler assembly 30. A circular retaining spring member or C-clip 110 engages a recess on the cylindrical member 46 and holds it in its proper inward position. The two shafts 112 and 114 are made of hardened steel and provide additional security against possible hacksaw attacks, for the assembly. The shaft 114 is a "roll pin", i.e.; it is free to roll with the movement of a saw, thus providing security against even the hardest saw. The springs 24 and 26 bear on the ends of the shafts 112 and 82, respectively. The circular end member 116 closes the left-hand inner end of the cylinder 38, and provides mounting and support for the small cylindrical tubes 118 and 120 which contain the long coil springs 24 and 26. Incidentally, the coil springs 24 and 26 are preferably about twice as long as the normal coil springs which are employed in conventional latches in view of the additional throw of the longlatch 12. It is also noted again, that because of the extended throw of the longlatch 12, the cylinder 38 should be substantially longer than that employed in conventional doors, to provide adequate strength and security, as well as operating space, for the longlatch 12 and other parts. Normally, the cylinder does not extend significantly into the transverse opening 36 (see FIG. 2). In the present case the disclosed design represents a unique and ingenious solution to the need to fit all of the desired components into a conventionally pre-cut door, while concurrently providing the desired additional spring length and cylindrical latch support to accommodate the extended one inch throw of the longlatch 12.

Incidentally, the circular support member 122 (see FIG. *7b*) is mounted within the tube 38 immediately to the right of the recess 124 as shown in FIG. *7a*. This member 122 has openings to support the front ends of tubes 118 and 120, permitting the passage of the shafts 112 and 82 into engagement with springs 24 and 26, and also supports the rear end of the deadlocking catch 84. The central opening in the support member 122 permits the movement of the three elongated plates 66, 68, and 70.

It may also be noted that the latch pulling member 66, in following the lever 60, moves not only axially with respect to the longlatch and the cylinder 38, but also has some transverse movement, required by the extended movement of the pin 74 on lever arm 60 through a circular path. This is in contrast with somewhat similar mechanisms used in deadlocking devices where the latch pulling member is secured to the latch, moves rectilinearly and therefore has reduced mechanical efficiency.

Certain aspects of the configuration of the deadlocking plunger and its relationship to the longlatch and the striker plate opening are also deserving of note. Specifically, a normal deadlocking plunger extends to the end of the latch. Accordingly, if the latch does not fully penetrate the opening in the striker plate, the deadlocking plunger may also go into the opening in the striker plate, and would therefore not operate in its intended manner. In the case of the present design, as shown in FIG. 1, however, the normal maximum extent of the deadlocking plunger 82 is only to a point back of the start of the bevel 22 on the front of the longlatch 12. Accordingly, once the longlatch 12 penetrates opening 18 (which makes a close fit with the main part of the longlatch 12), the deadlocking plunger cannot penetrate the opening in the striker plate; and the possibility of malfunction is thereby avoided.

It is noted in passing that the foregoing detailed description and FIGS. 1 through 7 of the drawings were included in my prior copending patent application cited hereinabove. FIGS. 8, 9, 10 and 11 show a slightly different preferred embodiment of the invention. The following description parallels that of the original description of FIGS. 1–7, to a substantial extent, and accordingly, attention is directed to the principal differences, the two knobs of FIG. 8, the inter-coupling between parts 266 and 268, and the configuration of the striker plate and latch holder.

More particularly, FIG. 8 is a cross-sectional view showing a longlatch 212, mounted in a door 214 for engagement with a striker plate 216 having a recess 218 for receiving the longlatch member 212, and a depressor portion 220 for engaging a bevel 222 on one corner of the longlatch 212 and for causing the movement of the longlatch 212 inwardly of the door 214, against the spring pressure of the two coil springs 224 and 226.

In FIG. 8, it may be noted that the longlatch 212 is mounted within a cylindrical housing 238 which extends from the front edge of the door 214 through the length of the smaller hole corresponding to hole 34 of FIG. 2, and most of the way across the larger hole 236. This gives good support to the longlatch 212 and provides good security and impact resistance for the entire assembly, if an effort is made to force the door 214 while the longlatch 212 is in position in the recess 218. A transverse shaft 262 which is connected to an inside door knob 228 and an outside door knob 229, and two transverse bolts 308 which hold the inside and outside door knob assemblies firmly against the door 214, pass through the cylindrical housing 238.

Figures 9A, 9B:
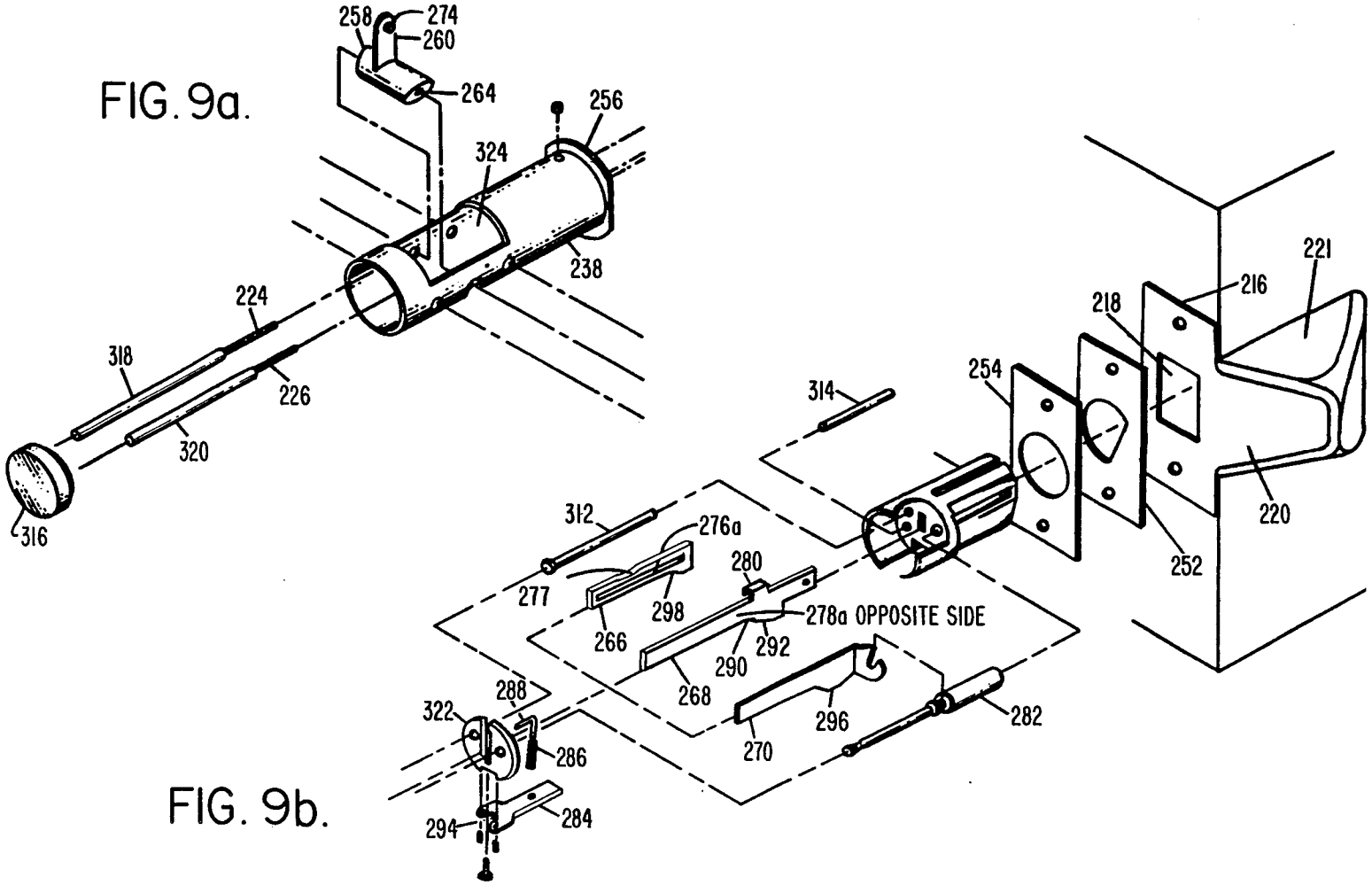

FIG. 9, made up of FIG. 9*a* and FIG. 9*b*, is an exploded view of a portion of the deadlocking longlatch assembly shown in cross-section in FIG. 8. The major components shown in FIG. 9 which have not been specifically referenced above, include the latch faceplate, made up of two plates 252 and 254, with the front plate 252 being exposed at the edge of the door and the plate 254 being mounted on the other side of the flange 256 at the front edge of the elongated cylinder 238, thereby holding the cylinder 238 firmly in place in door 214. Incidentally, the elongated cylinder 238 appears in FIG. 9*a*, while the plates 252 and 254 appear toward the right in FIG. 9*b*.

A cam member 258 provided with a lever arm 260 is mounted on the shaft 262 (see FIG. 8) for rotation as the inside knob 228 or the outside knob 229 is rotated. The shaft 262 may be square, or rectangular, or round with a flat on one side, or any shape other than round, for engaging with a mating hole 264 extending through the body of the cam member 258. There are three flat members 266, 268 and 270 which are mounted close to one another, as shown in FIG. 9*b*. The upper one of these flat strips, a latch pulling strip 266, is provided with a long (more than one inch) slot 276*a* which is engaged at the rear end (away from the longlatch 212) by a pin 274 on the lever arm 260 secured to the cam member 258. The central flat shaft 268, shown in FIG. 9*b* and separately in FIG. 10, is rigidly secured to the longlatch 212. A pin 278*a* on the member 268 extends through the slot 276*a* in the latch pulling strip 266 at a point near the front (toward the longlatch 212) of the slot 276*a*, with a bent arm 280 on part 268 extending over the latch pulling strip 266 to preclude disengagement of the pin 278*a* from the slot 276*a*. Because of the bent arm 280, there is a notch 277 in the top of latch pulling strip 266 which, when aligned with bent arm 280, allows pieces 266 and 268 to be mated when the apparatus is first assembled. When the inside knob 228 or the outside knob 229 is turned, and the camming member 258 is rotated, the lever arm 260 is moved counterclockwise as shown in FIG. 9*a*, the front of the slot 276*a* engages the pin 278*a* (see FIG. 10), and the central shaft 268 together with the longlatch 212 are retracted and moved to the left as shown in FIG. 9, against the force of the coil springs 224 and 226.

When the door 214 is closed and the longlatch 212 is depressed into the door 214 by the depressor portion 220, the slot 276*a* in the latch pulling strip 266 slides inward upon the pin 274 without moving the pin 274. Thus, no torque is exerted upon the shaft 262, permitting the door 214 to be locked by simply pulling the door 214 closed with the knobs 228 and 229 in the locked position, in which case the shaft 262 is held rigid or nearly rigid.

The operation of the deadlocking plunger 282 and the deadlocking catch 284 will now be described. In general, the purpose of a deadlocking plunger is to prevent movement of the latch by direct engagement of a latch with a tool or a credit card, for example, when the door is closed, and the latch is properly located in the opening in the striker plate. In operation, the deadlocking plunger, such as plunger 282, rests on the outer surface of the striker plate and does not penetrate the striker plate, and this operation, which is of course different from the operation of the deadlocking plunger 282 which moves with the longlatch 212 when the door is open, is employed to implement the deadlocking function.

The small coil spring 286 guided by the pin 288, is mounted below the deadlocking catch 284 to mechanically bias the front end of the deadlocking catch upwardly so that it is behind the detent formed by the rear edge 290 of the downwardly extending lug 292 of the central shaft 268. Incidentally, the deadlocking catch 284 is pivoted at its rear end 294, at the bottom of disk 322. Now, when the deadlocking plunger is in its forward position, fully extended, when the door is open, the lower surface 296 on the deadlocking catch disabling strip 270 engages the front end of the deadlocking catch 284 and pushes it down so that it cannot engage the detent 290. Then, as the door is swung closed, the depressor plate 220 may freely force the longlatch 212 into its retracted position against the force of the coil springs 224 and 226. It may also be noted that the longlatch 212 is provided with a slot at its lower rear end to receive the (inactive) deadlocking catch 284 as the door is closed and the longlatch 212 moves into cylinder 238.

Now, assuming that the door is closed and that the latch is in its locked position in the recess 218, the deadlocking plunger 284 will be resting on the face of the striker plate 216, and the deadlocking catch disabling strip 270 will be pushed to the rear, so that it does not interfere with the upward movement of the deadlocking catch 284. Under these conditions, the front edge of the deadlocking catch 284 will lie behind the detent 290, so that a mechanical force by a tool or a credit card on the longlatch 212 would not cause its movement toward the retracted or opening condition. However, when the inside knob 228 or the outside knob 229 is turned, as mentioned above, the latch pulling strip 266 is moved to the left, and, prior to the engagement of the pin 278*a* on the central shaft 268 with the front of the slot 276*a*, the lower camming surface 298 on the latch pulling strip 266 will engage the deadlocking catch 284 and push it down, away from possible engagement with the detent 290. Thus, as the front of the slot 276*a* reaches the pin 278*a*, the deadlocking catch 284 has been disabled, and the central shaft and its associated longlatch are free to be moved to the retracted position.

The two shafts 312 and 314 are made of hardened steel and provide additional security against possible hacksaw attacks, for the assembly. The shaft 314 is a "roll pin", i.e., it is free to roll with the movement of a saw, thus providing security against even the hardest saw. The springs 224 and 226 bear on the ends of the shafts 312 and 282, respectively. The circular end member 316 closes the left-hand inner end of the cylinder 238, and provides mounting and support for the small cylindrical tubes 318 and 320 which contain the long coil springs 224 and 226. Incidentally, the coil springs 224 and 226 are preferably about twice as long as the normal coil springs which are employed in conventional latches in view of the additional throw of the longlatch 212. It is also noted again, that because of the extended throw of the longlatch 212, the cylinder 238 should be substantially longer than that employed in conventional latches, to provide adequate strength and security, as well as operating space, for the longlatch 212 and other parts. Normally, the cylinder does not extend significantly into the transverse opening 236. In the present case the disclosed design represents a unique and ingenious solution to the need to fit all of the desired components into a conventionally pre-cut residential door, while concurrently providing the desired additional spring length and cylindrical latch support to accommodate the extended one inch throw of the longlatch 212.

Concerning the striker plate, in view of the greater length of the protruding portion 220 as shown in FIG. 9 as compared with a conventional striker plate, the backing member 221 is provided. This avoids the possibility that clothes or the like will be caught on the extending portion of the striker plate.

Attention is also directed to FIG. 11 of the drawings wherein the striker plate and latch holder is made of a single long piece of sheet metal having the section 402 upon which the longlatch bears as the door is being closed, and the bent-back portion 404 which protects against catching of clothes or the like on the assembly.

Two additional patents which may be noted in passing are J.A. Sherman U.S. Pat. No. 188,308, granted Mar. 13, 1877, and W. R. Schlage U.S. Pat. No. 2,370,690, granted Mar. 6, 1945. Initially, it is noted that these door latch arrangements were apparently not intended for use in standard pre-cut conventional doors as disclosed in FIG. 2 of the present drawings, and as required by the appended claims.

Further, the total depth of the entire latch assembly must be less than 3 7/16 inches, which is the sum of the $2\frac{3}{8}$ inch spacing of the transverse hole from the edge of the door as shown in FIG. 2, combined with the one and one-sixteenth inch radius of the transverse hole. As it happens, the Sherman patent drawing measures exactly 3 7/16 inches from the face of the door to the end of the housing within the door. The total outward extent of the Sherman bolt from the face of the door is only one-half inch in its furthest outward extent, much less than the one inch "throw" of the longlatch of the present invention.

Concerning the Schlage patent, FIG. 2 of that patent shows a maximum extent of the bolt of $\frac{3}{8}$ inch, a depth of the assembly from the face of the door of $2\frac{5}{8}$ inches, and a vertical extent of the assembly of $1\frac{1}{8}$ inch. Scaling all of these dimensions up by one-third would give a depth of penetration of $\frac{1}{2}$ inch, a depth of $3\frac{1}{2}$ inches, and height of $1\frac{1}{2}$ inches. Accordingly, even with the transverse opening in the pre-cut door cut to receive the housing of $1\frac{1}{2}$ inch vertical extent to a depth of $3\frac{1}{2}$ inches, the bolt of Schlage would only extend *one-half inch* from the door. Thus, the Schlage device first clearly would not fit in the standard pre-cut door openings, with the 15/16 inch hole from the edge of the door, but also would only have *half* of the desired one inch length desirable for dead bolt force resistance.

In conclusion, it is to be understood that the foregoing detailed description and accompanying drawings relate to one illustrative embodiment of the invention. Other arrangements may be employed to implement various features of the invention without departing from the spirit and scope of the present invention. Thus, by way of example, and not of limitation, the precise mechanical arrangements for implementing the deadlocking, and biasing, as well as other mechanical functions and movements may be accomplished by alternative arrangements. For example, the latch depressor on the door frame could be eliminated in a configuration in which the entire end of the longlatch is beveled and the deadlocking plunger extends as far as the longer side of the longlatch, and in which the longlatch and the deadlocking plunger are mechanically linked so that (1) when the door is opened, the longlatch and the deadlocking plunger both extend only to a distance of approximately one-half inch and (2) when the door is closed, the deadlocking plunger strikes the striker plate and is therefore prevented from extending, thus releasing the longlatch so that it may extend one inch or more. Accordingly, the present invention is not limited to that precisely as shown and described hereinabove.

What is claimed is:

1. An assembly including a deadlocking latch which extends one inch out of a door for normal use with standard pre-cut external doors having a transverse opening substantially $2\frac{1}{8}$ inches in diameter located substantially $2\frac{3}{8}$ inches from the edge of the door, and a hole substantially 15/16 inch in diameter extending from the edge of the door to said transverse opening, comprising:

a longlatch;

means for mounting said longlatch for movement between a fully retracted position and a position where said longlatch extends at least one inch out from the edge of a door;

a striker plate having a flat portion with an opening to receive said longlatch, and an extended depressor means oriented at a substantial angle with respect to said flat portion for moving said longlatch to its retracted position as the door is closed;

spring means mounted within said operating space and extending toward said longlatch from a point substantially beyond the center of the said larger transverse opening and away from the edge of the door, for normally biasing said longlatch to the fully extended position;

said depressor means on said striker plate extending to a distance in the order of one inch away from the plane of said flat portion thereof;

means including a knob or rotatable handle for mounting on at least one side of the door for substantial alignment with the center of the transverse opening for retracting said longlatch the full one inch extension thereof from said striker plate;

plates covering the inside and outside ends of the transverse opening, said plates being held against the door by two security bolts passing through the transverse opening and engaging both plates;

means including (1) a deadlocking plunger mounted adjacent to said longlatch for movement substantially parallel to said longlatch and (2) mechanical linkage means between said deadlocking plunger and said longlatch, to detent the longlatch when the longlatch is in its extended position and the deadlocking plunger is in its retracted position, and to release said longlatch when said deadlocking plunger is in its extended position; and said assembly having no dimensions which significantly exceed the space provided by the openings in standard pre-cut doors as set forth hereinabove.

2. An assembly as defined in claim 1 wherein said assembly includes means consisting solely of said springs for providing force for moving said longlatch from its fully withdrawn position to its fully extended position extending at least one inch from the door.

3. An assembly as defined in claim 1, wherein said security bolts, and the axle between two door knobs used in withdrawing said longlatch are displaced vertically with respect to the centerline of said transverse hole through the door, allowing space for said springs.

4. An assembly as defined in claim 1, wherein a shaft attached rigidly to said longlatch extends completely above said security bolts, and extends inwardly of said door beyond the midpoint between said security bolts, when said longlatch is in said withdrawn position.

5. An assembly as defined in claim 4, wherein a latch pulling strip is mechanically coupled to said rigidly attached shaft to withdraw said longlatch, extends completely above said security bolts, and extends inwardly of said door beyond the midpoint between said security bolts, when said longlatch is in said withdrawn position.

6. An assembly as defined in claim 1, including a deadlocking device disabling strip means which in its extended position prevents said longlatch from deadlocking by blocking a deadlocking strip which would otherwise engage a vertical surface behind said longlatch, said deadlocking device disabling strip means extending completely above said security bolts, and extends inwardly of said door beyond the midpoint between said security bolts, when said longlatch is in said withdrawn position.

7. An assembly as defined in claim 5, wherein there is slot means more than one inch long in said latch pulling strip, said slot means engaging (1) a pin on said rigidly attached shaft at its outward end, and (2) a pin attached to the latch withdrawing mechanism at its inward end, such that, when said door is closed and said longlatch is pushed inward, said slot slides inward upon said withdrawing pin without moving said pin, permitting the door to be closed when said latch withdrawing mechanism is rigid, as when in the locked position.

8. An assembly as defined in claim 1, wherein shield means are provided adjacent said depressor means, to prevent clothing and other articles from catching on said depressor means.

9. A lock as defined in claim 1, wherein said depressor means is extended beyond the point where said longlatch strikes it, and bent toward the door frame to prevent clothing and other articles from catching on said depressor means.

10. An assembly for providing deadbolt security for normal use with standard pre-cut external doors, comprising:

a longlatch;

a striker plate having a flat portion with an opening to receive said longlatch, and an extended depressor means oriented at a substantial angle with respect to said flat portion for moving said longlatch to its retracted position as the door is closed;

support assembly means having a length to extend substantially from the edge of the door not only through the smaller standard hole in pre-cut doors which extends from the edge of the door, but also through more than half of the larger transverse opening in pre-cut doors, to provide the desired support and operating space for the extended travel of the longlatch and associated operating mechanism;

spring means for normally biasing said longlatch to fully extended position, said spring means constituting the sole means in said assembly for providing force to advance said longlatch to its fully extended position;

said depressor means on said striker plate extending to a distance in the order of one inch from the plane of said flat portion thereof; and manually operative means for retracting said longlatch from said striker plate.

11. A deadlocking longlatch assembly as defined in claim 10 wherein deadlocking plunger means are provided for preventing external withdrawal of said longlatch when said longlatch is in the locked position extending through said opening in said striker plate.

12. A deadlocking longlatch assembly as defined in claim 10 wherein said retracting means includes a rotating lever arm and an elongated retracting member extending from said lever arm to said longlatch, said retracting member being free to move in a direction transverse to the axis of the longlatch to follow the lever arm, as well as parallel to the axis of the longlatch, whereby the extended movement of the longlatch may be accommodated and the springs compressed with mechanical efficiency.

13. A deadlocking longlatch assembly as defined in claim 10 wherein said support assembly extends substantially across the entire diameter of the larger transverse opening in a pre-cut door.

14. A deadlocking longlatch assembly as defined in claim 10 wherein said support assembly is at least two and one-half inches in length.

15. A deadlocking longlatch assembly as defined in claim 10 wherein said spring means includes two compression coil springs, and a pair of cylindrical tube means are provided for containing and directing the force of said springs to bias said longlatch outwardly from the door, said spring extending substantially across the transverse opening in pre-cut doors.

16. An assembly including a deadlocking latch which extends one inch out of a door for normal use with standard pre-cut external doors having a transverse opening substantially 2⅛ inches in diameter located substantially 2⅜ inches from the edge of the door, comprising:

a longlatch;

means for mounting said longlatch for movement between a fully retracted position and a position where said longlatch extends at least one inch out from the edge of a door;

spring means mounted within said operating space and extending toward said longlatch from a point substantially beyond the center of the said larger transverse opening and away from the edge of the door, for normally biasing said longlatch to the fully extended position;

means including a knob or rotatable handle for mounting on at least one side of the door for substantial alignment with the center of the transverse opening for retracting said longlatch the full one inch extension thereof;

plates covering the inside and outside ends of the transverse opening, said plates being held against the door by two bolts passing through the transverse opening and engaging both plates;

means including (1) a deadlocking plunger mounted adjacent to said longlatch for movement substantially parallel to said longlatch and (2) mechanical linkage means between said deadlocking plunger and said longlatch, to detent the longlatch when the longlatch is in its extended position and the deadlocking plunger is in its retracted position, and to release said longlatch when said deadlocking plunger is in its extended position.

* * * * *